United States Patent [19]

Mileham

[11] Patent Number: 4,615,161

[45] Date of Patent: Oct. 7, 1986

[54] EXPANSION JOINT

[75] Inventor: Glen B. Mileham, New Germany, South Africa

[73] Assignee: AEPLC, England

[21] Appl. No.: 675,202

[22] Filed: Nov. 27, 1984

[30] Foreign Application Priority Data

Nov. 28, 1983 [ZA] South Africa ..... 83/8851

[51] Int. Cl.[4] ..... E04B 1/62

[52] U.S. Cl. ..... 52/396; 404/69

[58] Field of Search ..... 52/396, 403, 573; 404/69, 65

[56] References Cited

U.S. PATENT DOCUMENTS

| | | | |
|---|---|---|---|
| 3,595,142 | 7/1971 | Via | 404/49 |
| 3,824,025 | 7/1974 | Beutler | 404/48 |
| 4,129,967 | 12/1978 | Barlow | 52/396 |
| 4,290,713 | 9/1981 | Brown | 52/396 |
| 4,388,016 | 6/1983 | Levey | 52/396 |

FOREIGN PATENT DOCUMENTS

| | | | |
|---|---|---|---|
| 3015011 | 10/1981 | Fed. Rep. of Germany | 404/69 |
| 1175745 | 12/1969 | United Kingdom | 404/48 |

*Primary Examiner*—Henry E. Raduazo

*Attorney, Agent, or Firm*—Price, Heneveld, Huizenga & Cooper

[57] ABSTRACT

An expansion joint for a structure such as a bridge or roadway comprising a pair of elongate tubes 14, 16 each having a longitudinal slot 24, 26 and a relatively wider channel 32, 34 and a folded strip 22 of polymeric material. The tubes 14, 16 are fixed to the structure by means of anchors 18, 20. The strip has bulbous edge portions 36, 38 which are located in the channels 32, 34. The strip 22 and tubes 14, 16 are located below the level of the structure surface.

5 Claims, 2 Drawing Figures

EXPANSION JOINT

BACKGROUND OF THE INVENTION

The present invention relates to expansion joints used in civil engineering projects and more particularly to water proof joints for bridges and the like.

Many forms of expansion joints have been proposed from simple concrete noses bridged with compressible material such as rubber, neoprene or the like which rely on adhesion to maintain their position. Other forms include complicated joints involving metal, usually steel strips with a polymeric material spanning the joint. The conventional form of such a joint comprises opposed strips of extruded steel having a longitudinal claw formation adapted to receive enlarged flange portions of the polymeric strips. The steel extrusions form part of the road surface and are welded to large steel anchorages which are then cast in concrete. Large anchors are necessary for this system as the wheel forces of vehicles must be transmitted through them from the extrusions to the structure.

SUMMARY OF THE INVENTION

Although these joints are effective, they are very expensive and it is an object of the present invention to provide a joint which avoids the disadvantages inherent in the simple joints (such as displacement of the rubber strip) and yet has the advantages of the expensive steel joints.

According to the present invention there is provided an expansion joint for location between two portions of a structure comprising a pair of spaced elongate channel members each defining a channel, and a strip of resilient material spanning the space between the channel members, the strip having formations arranged to be received in the channels, the channel members and the strip being below the surface of the two portions of the structure. The channel members and strip are thus located below the impact zone and by reason of this location may be connected to lightweight anchorages.

Preferably, the strip is of a polymeric material and preferably, the channels have a relatively wide interior and a relatively narrow neck portion In a prefered embodiment the channel members each comprise one or more lengths of lightweight tubing having a longitudinal slot narrower than the width of the tubing.

The openings to the channels may face generally upwards and the strip preferably has an enlarged portion at each lateral edge adapted to fit in the channel1s. The strip may also include a folded section extending downwards between the enlarged portions, and edges engaging the length of the portions of the structure. Thus the strip of polymeric material may include "dumbbell" formations at either end and these formations are forced into the channels.

The channels are preferably made from a suitable metal such as stainless steel which is welded or otherwise joined to anchorages in the concrete.

According to another aspect of the invention, there is provided a method of assembling a joint between two portions of a structure which comprises: attaching a pair of channel members each definning a channel, to a series of anchorages; locating elongate plug means in the channels; spacing the channel members with a shutter; pouring concrete around and about the anchorages to a level above the level of the channel members and allowing this to set; removing the plug means and the shutter; and inserting an elongate strip of resilient material into the channels.

BRIEF DESCRIPTION OF THE DRAWINGS

The invention may be carried into practice in various ways and one embodiment will now be descrided by way of example with reference to the accompanying drawings in which.

DESCRIPTION OF THE PREFERRED EMBODIMENTS

Figure 1:
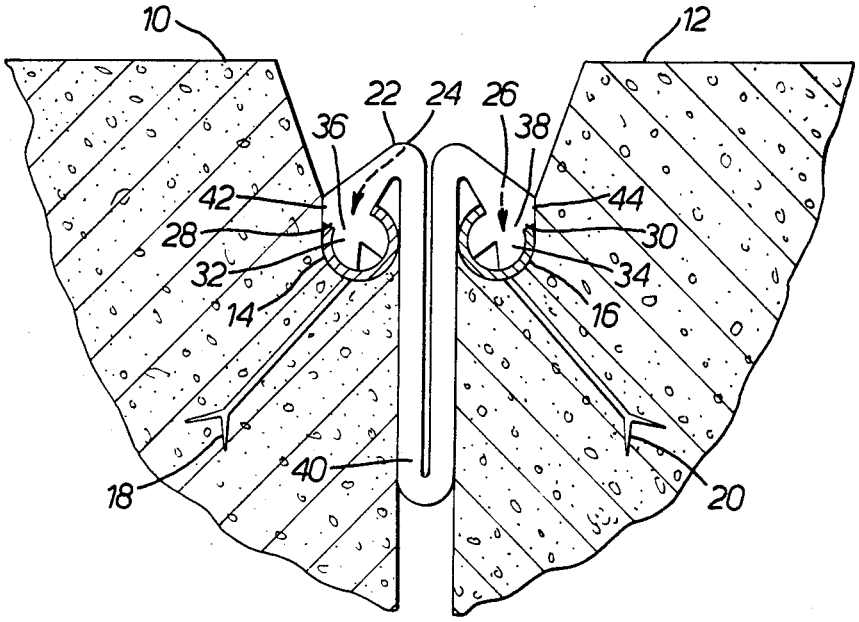
FIG. 1 is a vertical transverse section through a joint in accordance with the invention.

As shown in FIG. 1, the joint comprises a pair of elongate stainless steel tubes 14, 16 and an expandable neoprene strip 22. The tubes 14, 16 have anchors 18, 20 welded to them at intervals which are embedded in the concrete (or other suitable material) which forms two portions 10, 12 of the structure on either side of the joint.

The tubes 14, 16 each have a longitudinal slit 24, 26 thereby defining a neck 28, 30 and a channel 32, 34. The strip has at each edge, a bulbous portion 36, 38 which is located in its corresponding channel 32, 34 and a downwardly folded central region 40 to allow the two portions 10, 12 to move apart. The outside edges 42,44 of the strip engage the sides of the portions 10,12.

Although simple forked anchors 18, 20 are shown, it will be appreciated that these may be curved or otherwise suitably shaped to engage anchorages fixed to the structure and/or embedded in the concrete portions 10, 12.

The shoulders 46, 48 of the concrete portions 10,12 are chamfered. Due to the position of the tubes 14, 16 and the strip 22 below the level of the surface of the structure, any impact forces from traffic passing over the joint are not transmitted through the sealing or anchor system as in prior art systems, but are applied directly to the structure.

Figure 2:
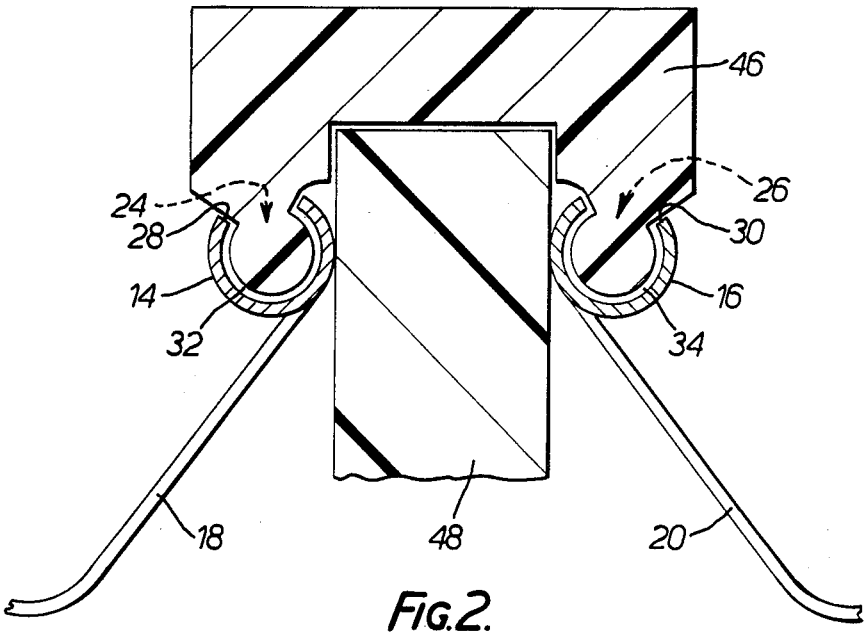
FIG. 2 is a view similar to FIG. 1 showing a stage in the assembly of the joint.

FIG. 2 illustrates the assembly of the joint shown in FIG. 1. Anchors 18, 20 are welded at intervals along the tubes 14, 16, and a polymeric plug 46 is inserted into the channels 32, 34. A polystyrene shutter 48 is placed in between the two parts of the structure where the joint is to be located and the plug/tube/anchor assembly is positioned over the shutter with the anchors 18, 20 extending downwards. The anchors 18, 20 are optionally welded to anchorages in the structure.

Concrete is then poured around and about the anchors 18, 20 and the tubes 14, 16 and allowed to set to form the two structure portions 10, 12. The plug 46 is removed to expose the channels 32, 34 in the tubes 14, 16 and the shutter 48 is withdrawn leaving the tubes 14, 16 at the correct spacing. The strip 22 can then be placed in position as shown in FIG. 1, though in this view, the joint is "closed" rather than in its expanded form.

Obviously, numerous modifications and variations of the present invention are possible on the light of the above teachings. It is therfore to be understood that within the scope of the appended claims, the invention may be practiced otherwise than as specifically described herein.

I claim:

1. Means for forming a recessed expansion joint to be seated in a narrow slot between two portions of a structure formed about said joint each portion having a surface in the same horizontal plane, said means comprising a pair of spaced elongated channel members one located on each side of the joint and recessed below the surface of said structure and anchored to said structure, each of said channel members having an upwardly opening slot extending the length thereof, and a strip of resilient material spanning the space between said channel members, said strip having a pair of legs forming a U-shaped body portion, the upper ends of said legs being reversely bent and having outwardly extending header portions, the legs of said body being generally parallel and positioned immediately adjacent each other to form a closure member the cross-sectional thickness of the legs of which is substantially equal to the width of said slot, said legs extending downwardly into and normally parallel to the sides of said slot, said strip having a pair of coupler elements one on the end of each of said header portions and of a size and shape to be detachably inserted through said slots into said channels, anchor means on each of said channels for securing the channels to the structure to be formed, said channel members and said strip both being recessed below said surfaces of said two portions of said structure.

2. An expansion joint according to claim 1 wherein said channel members each comprise a length of resilient tubing having an internal diameter approximately that of one of said coupler elements, said channels forming a longitudinal slot in said tubing, said slot being narrower than the width of said tubing whereby said coupler elements are snap fitted into said channel members.

3. An expansion joint according to claim 1 wherein said strip is of a polymeric material.

4. An expansion joint according to claim 1 wherein said channels have a relatively wide interior and a relatively narrow neck portion.

5. An expansion joint according to claim 4 wherein said slots face generally upwards.

* * * * *